US006125812A

United States Patent [19]

Garabedian

[11] Patent Number: 6,125,812

[45] Date of Patent: Oct. 3, 2000

[54] FUEL INJECTION SPLIT ENGINE

[75] Inventor: Arthur Garabedian, Fullerton, Calif.

[73] Assignee: Dudley Frank, Santa Ana, Calif.

[21] Appl. No.: 09/090,669

[22] Filed: Jun. 4, 1998

Related U.S. Application Data

[63] Continuation of application No. 08/768,440, Dec. 17, 1996, Pat. No. 5,778,858.

[51] Int. Cl.[7] ..... F02D 17/02; F02D 41/36

[52] U.S. Cl. ..... 123/198 F; 123/481

[58] Field of Search ..... 123/481, 198 F

[56] References Cited

U.S. PATENT DOCUMENTS

| | | | |
|---|---|---|---|
| 3,500,803 | 3/1970 | Long | 123/478 |
| 4,129,109 | 12/1978 | Matsumoto | 123/481 |
| 4,146,006 | 3/1979 | Garabedian | 123/198 F |
| 4,509,488 | 4/1985 | Föster et al. | 123/481 |
| 4,608,952 | 9/1986 | Morita et al. | 123/198 F |
| 5,025,881 | 6/1991 | Poirier et al. | 123/481 |
| 5,038,739 | 8/1991 | Ishii | 123/481 |
| 5,099,816 | 3/1992 | Ohga et al. | 123/481 |
| 5,105,779 | 4/1992 | Thompson | 123/198 F |
| 5,154,151 | 10/1992 | Bradshaw et al. | 123/481 |
| 5,267,541 | 12/1993 | Taguchi et al. | 123/198 F |
| 5,408,966 | 4/1995 | Lipinski et al. | 123/198 F |
| 5,425,335 | 6/1995 | Miyamoto et al. | 123/198 F |
| 5,483,941 | 1/1996 | Cullen et al. | 123/481 |
| 5,540,633 | 7/1996 | Yamanaka et al. | 123/198 F |
| 5,555,871 | 9/1996 | Gopp et al. | 123/481 |
| 5,778,858 | 7/1998 | Garabedian | 123/481 |

OTHER PUBLICATIONS

PCT International Search Report for PCT/US97/23267, Mar. 25, 1998.

*Primary Examiner*—Andrew M. Dolinar
*Attorney, Agent, or Firm*—Knobbe, Martens, Olson & Bear, LLP

[57] ABSTRACT

An automobile includes an engine and an engine controller. The engine includes multiple cylinders. Each cylinder hyas a fuel injector connected to the engine controller. The engine controller has a first output which activates a first fraction of the fuel injectors. In addition, the engine controller has a second output which activates a second fraction of the fuel injectors. The engine controller also has an input which provides a timing signal synchronous with rotation of the engine and a sequencing circuit responsive to the timing signal. The sequencing circuit periodically alternates between the first and second output in synchronization with the rotation of the engine.

2 Claims, 10 Drawing Sheets

FUEL INJECTION SPLIT ENGINE

This is a continuation application of U.S. patent application Ser. No. 08/786,440, filed Dec. 17, 1996, now U.S. Pat. No. 5,778,858.

BACKGROUND OF THE INVENTION

1. Field of the Invention

The present invention relates to split engines, in which the average number of cylinders supplied with fuel is selected in accordance with different operating conditions. More specifically, the present invention relates to a fuel injected engine where specific injectors are deactivated to permit the engine to run on less than all its cylinders in a balanced manner.

2. Description of the Related Art

It is well known in the art that their are numerous benefits to operating an engine with less than a full complement of cylinders under certain loads and running conditions. Thus, it is possible to increase fuel economy and decrease exhaust emissions and engine wear by running an engine on a reduced number of cylinders when operating a vehicle under light loads. However, prior art techniques for implementing a split engine apparatus have had numerous drawbacks, hindering the commercial use of split engine technology. Typically, in an eight cylinder engine using current split engine technology, four cylinder mode operation is achieved by simply deactivating four cylinders, while six cylinder mode operation is achieved by deactivating two cylinders. This elementary implementation of split engine technology results in an engine that operates roughly, in an unbalanced manner, when operating with less than a full complement of cylinders. Another limitation to traditional split engine technology is that when an engine is operated with less than its full complement of cylinders, the same cylinders are repeatedly idled. This results in uneven wear of the cylinders and related hardware.

A further drawback to traditional split engine implementations is that a new split engine control unit is required to replace the non-split engine controller. This limitation requires that the split engine controller be installed by the car manufacturing as a "stock" controller, due to the extent of re-wiring and mechanical installation needed for the split engine controller. Thus, it would be expensive and impractical for a car owner to upgrade her car engine to split engine operation.

Yet another limitation to traditional split engine implementations is that the cylinder itself is deactivated so that no air flows through the deactivated cylinders. This results in higher percentage concentrations of pollutants in the engine exhaust than would be present if air continued to flow through the deactivated cylinder.

Therefore it would be desirable to have a split engine system which operated smoothly with less than a full complement of cylinders and which switched operating modes.

SUMMARY OF THE INVENTION

The present invention provides a split engine controller which advantageously can be inserted into a standard engine system in a motor vehicle without extensive rewiring of the engine system. Furthermore, the present invention provides a system and method for a split engine, where, in a given engine cycle, a fraction of the engine injectors are idled and a fraction of the engine injectors are activated.

Advantageously, different injectors are idled every engine cycle, providing for the even wear of the engine cylinders. Furthermore, the injectors are activated in a pattern which ensures the engine operates in a balanced manner. Additionally, the cylinders whose associated injectors are idled act as air pumps, reducing the percentage concentration of pollutants in the engine exhaust.

Furthermore, the present invention provides a method and system for operating an engine at 66.67% of full power by sequentially idling every third cylinder. Thus, when full engine power is not required, such as when the vehicle is cruising, the engine can be operated in 66.67% power mode, advantageously reducing fuel consumption and pollution emissions. Additionally, the firing sequence of the injectors is chosen to insure the balanced operation of the engine. Furthermore, cam pulses are used to synchronize the operation of the engine controller to the engine revolutions.

Another aspect of the present invention is a method and system for operating an engine at 50% of full power by alternately enabling a first half of the cylinders and a second half of the cylinders. Thus, when little engine power is required, such as when the vehicle is at idle, the engine operates in the 50% power mode, advantageously further reducing fuel consumption and pollution emissions.

Yet another aspect of the present invention is a method and system for operating an engine at 75% of full power by alternately enabling a first half of the cylinders, then all of the cylinders, and then a second half of the cylinders. Thus, when a significant percentage of the total available engine power is required, the engine operates in the 75% power mode, while advantageously resting alternate halves of the cylinders one third of the time.

DETAILED DESCRIPTION OF THE PREFERRED EMBODIMENT

Figure 1:
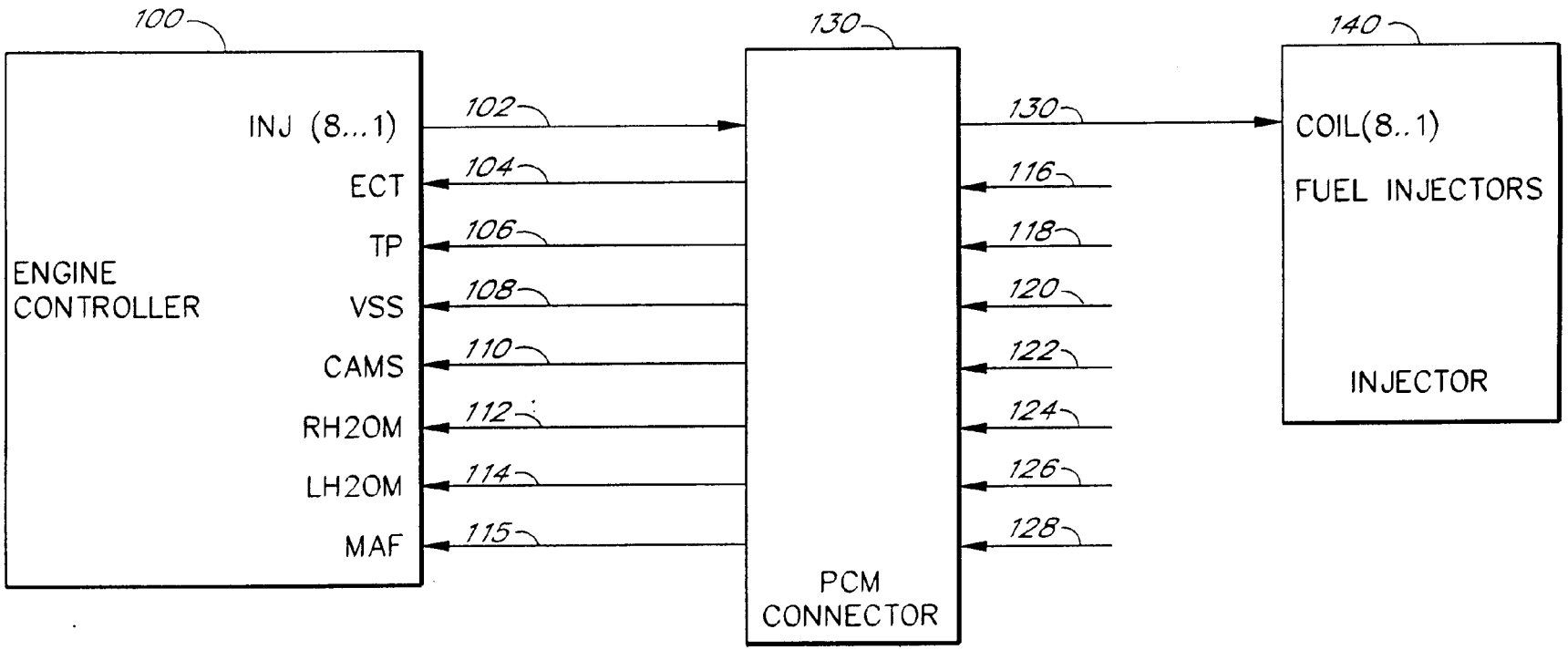
FIG. 1 (PRIOR ART)
FIG. 1 is a block diagram illustrating the interconnections of a prior art engine controller and fuel injectors.

FIG. 1 is a block diagram illustrating a standard, prior art, engine control system in a motor vehicle, such as, by way of example, a 1993 Ford Crown Victoria with a 4.6 liter V8 engine. A standard engine controller 100 is connected to fuel injectors 140. Engine sensor lines 116, 118, 120, 122, 124, 126, 128 pass through a power-train module connector (PCM) 130 and are connected to the standard engine controller 100 over respective signal lines 104, 106, 108, 110, 112, 114 115. The standard engine controller 100 is not capable of operating the engine in a split engine mode. The engine controller 100 monitors a number of operating condition sensors and engine-related sensors over the sensor lines 116, 118, 120, 122, 124, 126, 128 such as, respectively, an engine coolant temperature sensor (ECT), a throttle position sensor (TP), a vehicle speed sensor (VSS), a cam sensor (CAMS), a right hand oxygen sensor (RH20M), a left hand oxygen sensor (LH20M), and a manifold air flow sensor (MAF). The sensor signals lines are connected the corresponding engine controller inputs ECT, TP, VSS, CAMS, RH20M, LH20M, MAF. In response to the sensor readings, the engine controller 100 outputs eight injector enable signals INJ(8 . . . 1) over signal lines 102. For a given operating condition, each of the enable signals are timed to appropriately enable current to flow through a selected pair of fuel injector coils 140. Each engine cylinder has one fuel injector.

Figure 2:
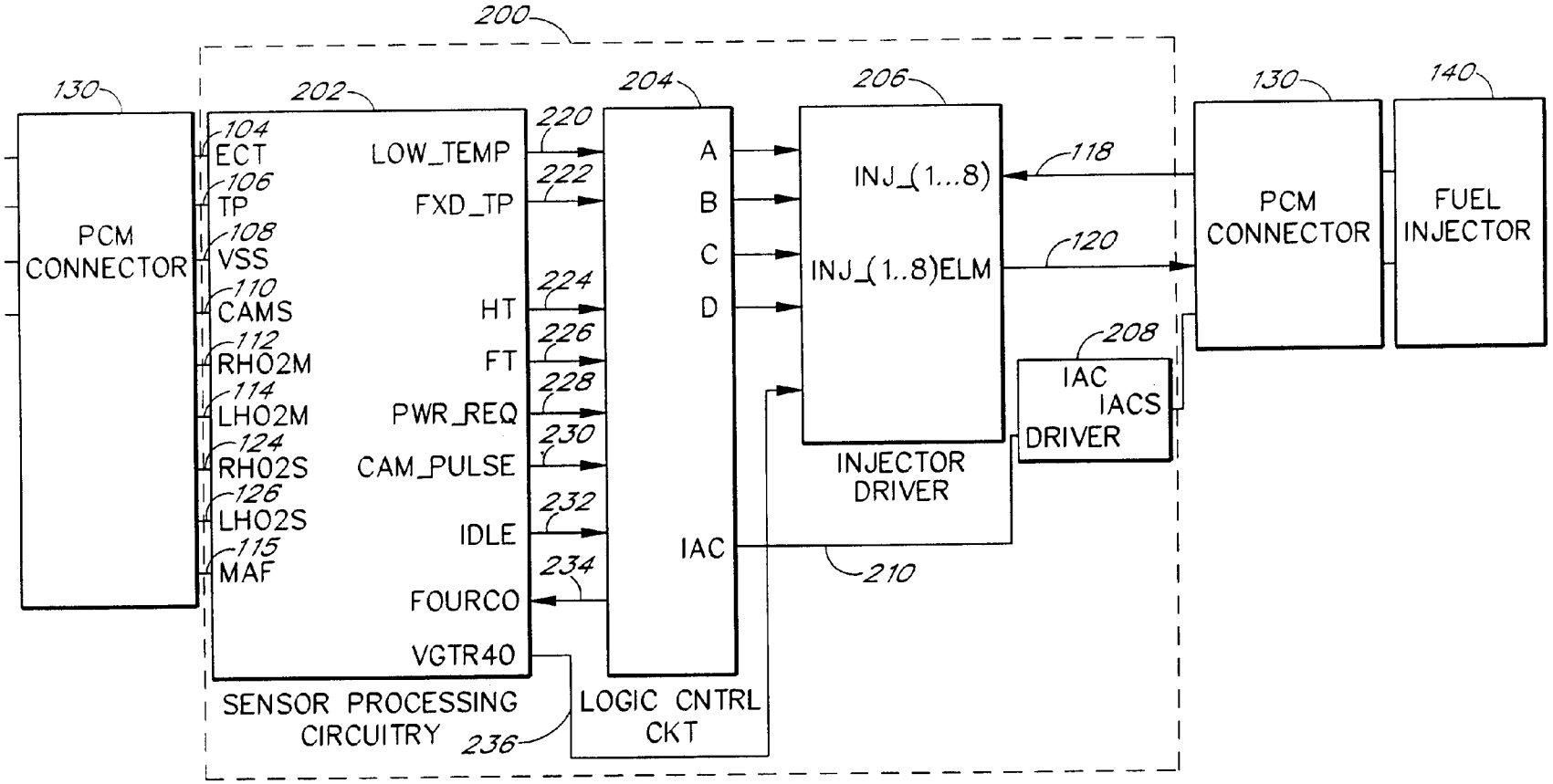
FIG. 2 is a block diagram of a preferred embodiment of the present invention and the surrounding environment.

FIG. 2 is a block diagram illustrating a preferred embodiment of the present invention. In the preferred embodiment, the engine is upgraded to split engine functionality by the expedient of unplugging the PCM connector 130 and its mate, and then plugging a split engine controller 200 into the PCM connector 130 and the mating connector. Hence, the engine can be easily upgraded by a consumer after the vehicle has been manufactured. This method of upgrading overcomes the limitations of past split engine implementations, which either required the engine controller 100 to be specifically designed by the manufacturer to enable split engine functionality or required significant rewiring of the vehicle. In another embodiment of the present invention, the split engine controller 200 is installed in the vehcile as standard equipment.

With reference to FIGS. 2 and, the split engine controller 200 taps off the sensor lines 116, 118, 120, 122, 124, 126, 128. Thus, both the engine controller 100 and the split engine controller 200 monitor the ECT, TP, VSS, CAMS RH20M, LH20M, and MAF sensors. However, for reasons that will be detailed below, the signals from the oxygen sensors RH20M, LH20M are intercepted by the split engine controller 200, and the split engine controller 200 in turn provides the standard engine controller 100 either the original oxygen sensor signals or simulated oxygen sensor signals on the signal lines 112, 114.

The split engine controller 200 includes sensor processing circuitry 202, logic control circuitry 204, injector driver circuitry 206 and idle air control (IAC) driver circuitry 208. The sensor processing circuitry 202 performs processing on the outputs of the sensors ECT, TP, VSS, CAMS RH20M, LH20M, MAF and derives a variety of performance and operational information. In response to the sensor signals, the sensor processing circuitry 202 generates the following outputs which are indicative of the operating environment of the engine and which are used by the split engine controller 200 to determine which mode to operate the engine in: a low temperature output LOW_TEMP, a fixed-throttle output FXD_TP, a half-throttle output HT, a full-throttle output FT, a power-required output PWR_REQ, a CAM_PULSE output, an IDLE output, and a VGTR40 output. These outputs are connected to the logic control circuitry 204 via respective signal lines 220, 222, 224, 226, 228, 230, 232, 236. The logic control circuitry 204 contains both combinatorial logic and state machines. In response to the signals generated from the sensor processing circuitry 202 the logic control circuitry 204 determines if the vehicle should be operated in a 50% power (4 cylinder) mode, a 66.67% power mode, a 75% (6 cylinder) more, or a 100% power (8 cylinder) mode. The logic control circuitry 204 further generates injector enables A, B, C, D and an idle air control enable IAC. The operation of the logic control circuitry 204 will be explained in greater detail below. The injector enables A, B, C, D are connected to the injector driver circuitry 206. The injector driver circuitry 206 is connected to the PCM connector 130 by the signal bus 120. The idle air control enable IAC is connected from the logic control circuit 204 to an idle air control driver 208 by a signal line 210. An output IACS of the idle air control driver 208 is connected to an engine idle air control solenoid.

Figure 3:
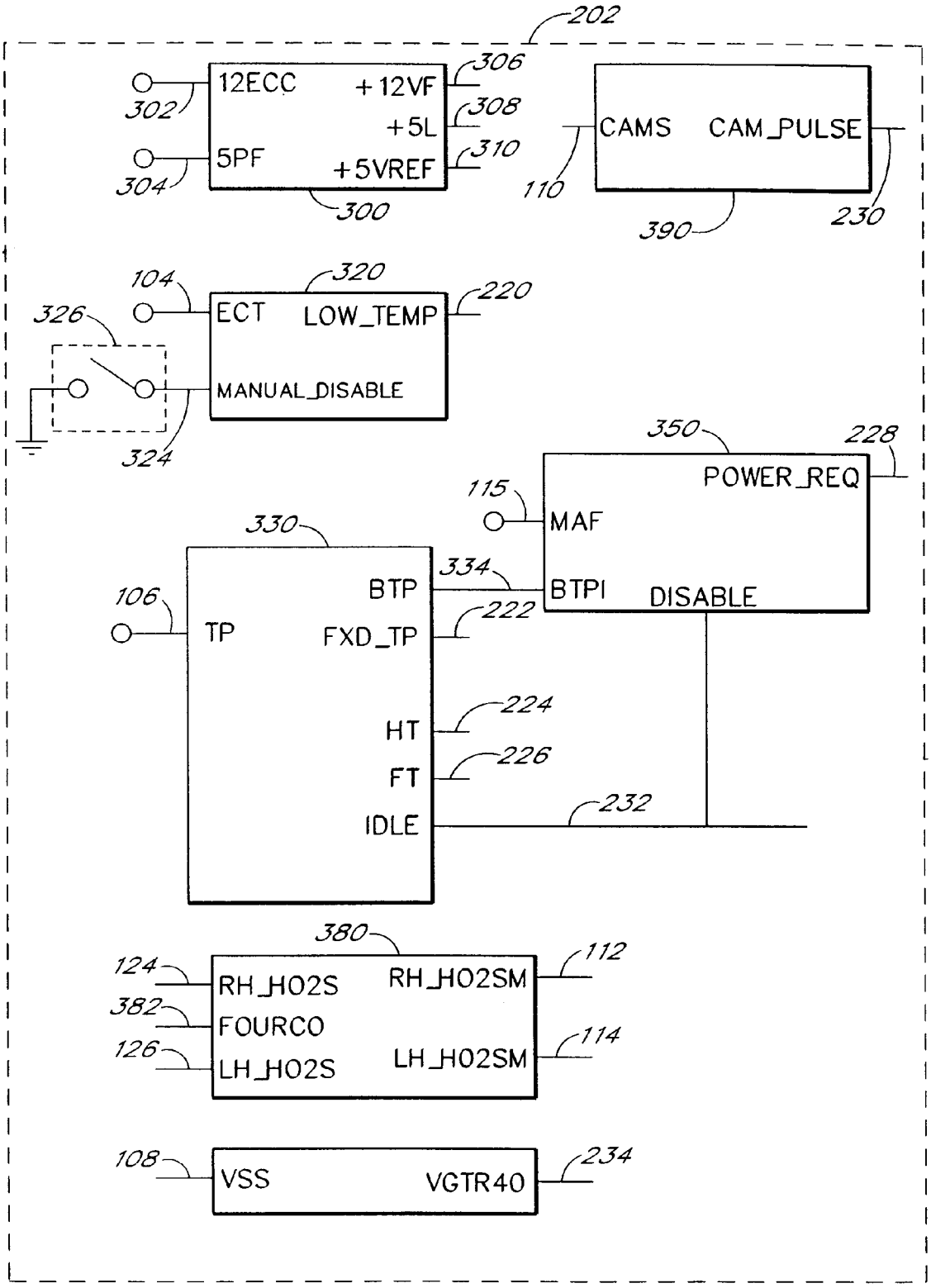
FIG. 3 is a more detailed block diagram of the sensor processing circuitry block illustrated in FIG. 2.

FIG. 3 is a detailed block diagram of a preferred embodiment of the sensor processing circuitry 202 illustrated in FIG. 2. A voltage regulator circuit 300 receives +12 VDC and +5 VDC on the voltage regulator's inputs 12ECC and 5PF respectively from the PCM connector 130. The voltage regulator circuit 300 filters and regulates the +12 VDC and +5 VDC input power and provides the resulting regulated and filtered power on the outputs +12VF, +5L, +5VREF to other portions of the split engine controller 200.

Figure 4:
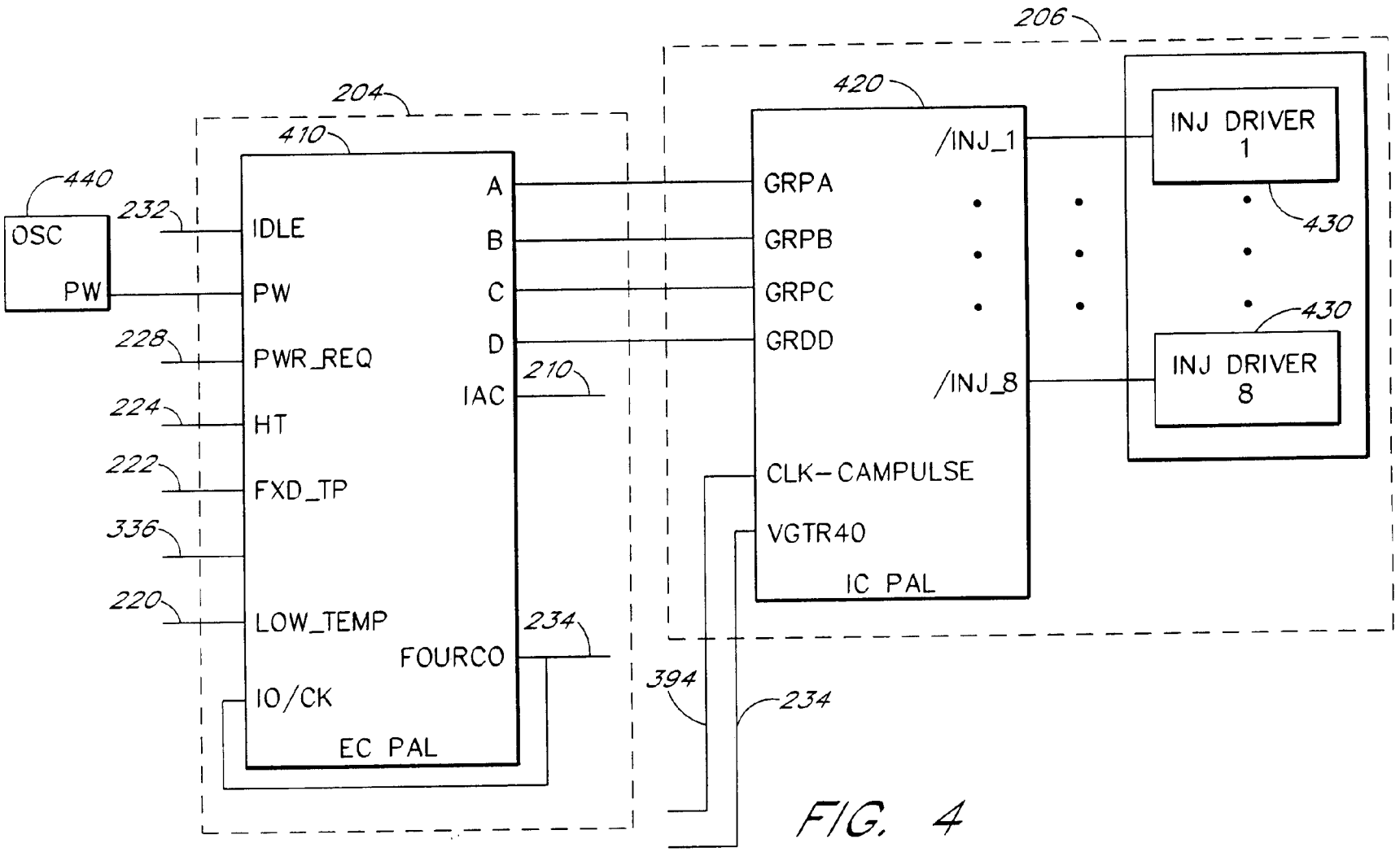
FIG. 4 is a detailed block diagram of the logic control circuitry and injector driver circuitry of the preferred embodiment illustrated in FIG. 2.

A CAM processing circuit 390 processes the cam pulses from the CAM sensor received on the line 110 and generates processed cam pulses on the output CAM_PULSE. One pulse is generated every two engine revolutions. The output CAM_PULSE is connected to a CLK-CAMPULSE input of an injector controller PAL 420 by the signal line 230, as illustrated in FIG. 4.

A temperature sensor processing circuit 320 receives on an input ECT a temperature sensor voltage representing the engine coolant temperature on the signal line 104 from the engine coolant temperature sensor. The temperature sensor processing circuit 300 inspects the voltage level of the signal 104 to determine if the engine coolant temperature is within the normal range for a warmed-up engine. If the engine coolant temperature sensor voltage indicates that the engine is cold, the temperature sensor processing circuit 320 responds by asserting a logic '1' on the output LOW_TEMP. The output LOW_TEMP is connected to the logic control circuit 204 by the signal line 220. As will be explained in detail below, if the temperature processing circuit 320 indicates that the coolant temperature is cold, the logic control circuit 204 responds by disabling the split engine function, instead operating the engine in a non-split engine mode. A manually operated disable switch 326 is located in the vehicle's passenger compartment. An operator may disable the split engine function by closing the disable switch 326. The temperature sensing circuit 320 responds by asserting a '1' on the LOW_TEMP output, which will again cause the logic control circuit 204 to operate the engine in a non-split engine mode.

A throttle sensor processing circuit 330 receives on an input TP a throttle position sensor voltage representing the throttle position on the signal line 106 from the throttle position sensor. The throttle position sensor processing circuit 330 inspects the voltage level on the signal line 106 and makes several determinations. First, the throttle sensor processing circuit 330 measures the rate of change of the voltage from the throttle position sensor. If the rate of change of the throttle position sensor voltage is less than a predetermined rate, indicating that the operator desires to accelerate slowly, or not at all, then the throttle position sensor processing circuit 330 asserts a logic '1' on the output FXD_TP, which is connected to the logic control circuit 204 by the signal line 222. Otherwise, a logic '0' is asserted on the FXD_TP output.

The throttle position sensor processing circuit 330 also determines if the throttle sensor voltage indicates the throttle is approximately at half-throttle or at approximately at full-throttle. If the throttle sensor voltage indicates that the throttle is at half-throttle, then the throttle position sensor processing circuit 330 asserts a logic '1' on the output HT which is connected to the logic control circuit 204 by the signal line 224. Otherwise a logic '0' is asserted on the output HT. If the throttle sensor voltage indicates that the throttle is at full-throttle, then the throttle position sensor processing circuit 330 asserts a logic '1' on the output FT which is connected to the logic control circuit 204 by a signal line 226. Otherwise a logic '0' is asserted on the output FT.

Furthermore, the throttle position sensor processing circuit 330 also determines if the throttle sensor voltage indicates the throttle is at an idle position. If the throttle sensor voltage indicates that the throttle is at idle, then the throttle position sensor processing circuit 330 asserts a logic '1' on the output IDLE. Otherwise a logic '0' is asserted on the IDLE output. The output IDLE is connected by the signal line 232 to an input DISABLE of an airflow comparison circuit 350 which measures throttle position versus airflow. The output IDLE is also connected to an input of the logic control circuit 204, as illustrated in FIG. 4. The throttle position sensor processing circuit 330 provides a buffered throttle position output BTP which is connected to a buffered throttle input BTPI of the airflow comparison circuit 350 by the signal line 334.

The airflow comparison circuit 350 compares the throttle position voltage received on the input BTPI, indicating throttle position, against a manifold airflow voltage, received on an input MAF, indicating the airflow through the engine intake manifold. The result of this comparison is provided on the output PWR_REQ, which in turn is connected to the logic control circuit 204 by the signal line 228. If the airflow comparison circuit 350 determines there is not sufficient airflow relative to the throttle position, indicating that the engine is under a heavy load, the circuit 350 asserts a logic '1' at the output PWR_REQ. Otherwise, a logic '0' is asserted at the output PWR_REQ. If, however, the throttle position is at idle, the throttle sensor voltage and the manifold sensor voltage may to too low for the circuit 350 to accurately compare the two. Thus, the throttle position sensor processing circuit 330 asserts a logic '1' at the output IDLE, disabling the circuit 350 and forcing the output PWR_REQ to be at a logic '0'.

A vehicle speed sensor processing circuit 382 receives on an input VSS a pulse train representing the vehicle speed on the signal line 108 from the vehicle speed sensor. The vehicle speed sensor processing circuit 382 inspects the frequency of the signal from the vehicle speed sensor to determine if the vehicle speed is greater than 40 miles an hour (MPH). If the vehicle speed sensor pulse train indicates the vehcile is travelling at a speed greater than 40 MPH, the vehicle speed sensor processing circuit 382 responds by asserting a logic '1' on the output VGTR40. The output VGTR40 is connected to the logic control circuit 204 by the signal line 234. As will be explained in detail below, the VGTR40 output is used by the split engine controller 200 to determine in which split engine mode to operate the engine.

An oxygen sensor circuit 380 receives an indication from the logic control circuit 204 from an output FOURCO, on the signal line 234, that the engine is operating in the four cylinder mode. Additionally, the oxygen sensor circuit 380 receives left and right oxygen sensor signals on respective signal lines 126, 124. When the engine is being operated in the four cylinder mode the unused cylinders advantageously act as air pumps, increasing the percentage of oxygen in the engine exhaust gases, thus reducing NOX emissions. The oxygen sensors indicates this increase in oxygen levels. However, if the oxygen sensor signals indicating this increase in oxygen levels were sent to the standard engine controller 100, the engine controller 100 would incorrectly conclude that a malfunction was occurring and thus the engine controller 100 would respond inappropriately. In order to overcome this problem, when the logic control circuit 204 indicates the engine is operating in the four cylinder mode, the oxygen sensor circuit 380 responds by decoupling the oxygen sensor signals from the standard engine controller 100. The oxygen sensor circuit 380 then sends simulated sensor readings over the signal lines 112, 114 to the engine controller 100 by outputing voltage levels that are in the normal range for the engine when operating in standard 8 cylinder mode. This causes the engine controller 100 to operate in appropriate fashion even when the split engine controller 200 has placed the engine in the four cylinder mode.

Figure 8:
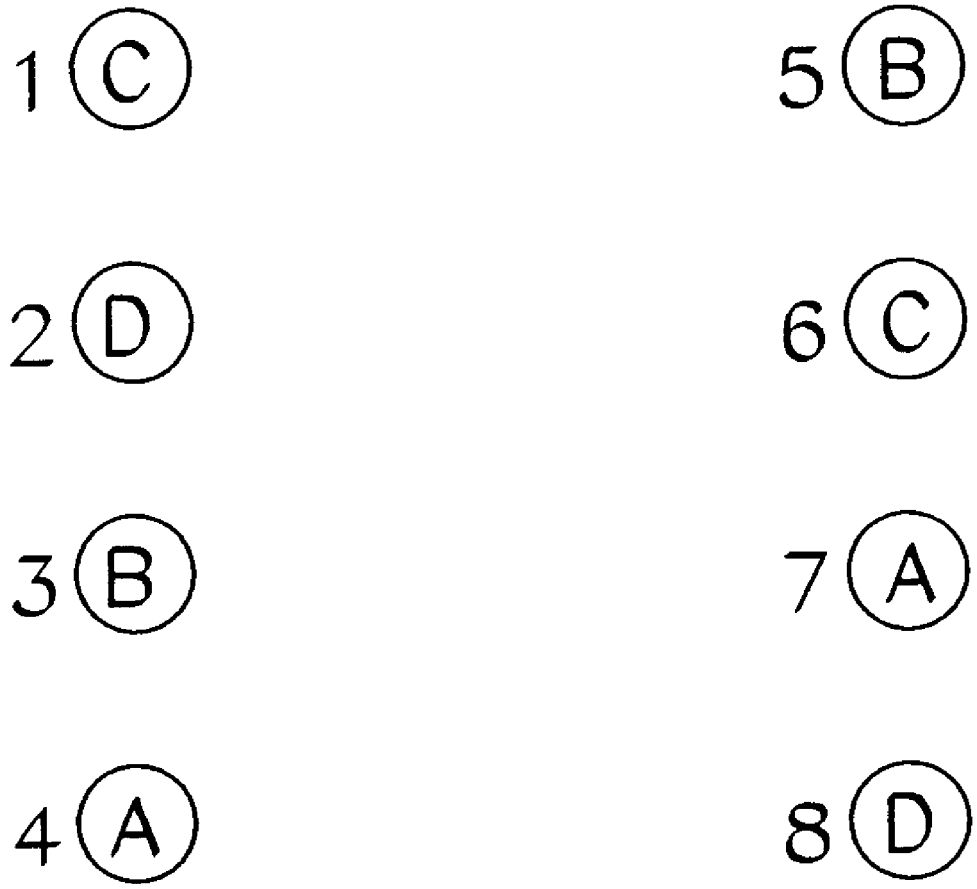
FIG. 8 illustrates the group assignments of the injectors and cylinders in the preferred embodiment.

FIG. 4, and the PAL equations in Appendix A and in Appendix B, illustrate the logic control circuit 204 and the injector driver circuitry 206 of a preferred embodiment of the present invention. The logic control circuit 204 includes an engine control (EC) programmable array logic (PAL) device 410 and an oscillator 440, while the injector drive circuitry 206 includes the injector controller (IC) PAL 420 and injector drivers 430. An output PW of the oscillator 440 is connected to an input PW of the EC PAL 410. The EC PAL 410 has four outputs A, B, C, D which are connected, respectively to inputs GRPA, GRPB, GRPC, GRPD of the IC PAL 420. The output IAC of the EC PAL 410 is connected to the IAC driver 208, while an output FOURCO is connected to a clock input CLK of the EC PAL 410 and to the sensor processing circuitry 202. For purposes of the following description and with reference to FIG. 8, the engine injectors are assigned to four groups A, B, C, D. Group A includes injectors 4 and 7. Group B includes injectors 3 and 5. Group C includes injectors 1 and 6. Group D includes injectors 2 and 8. Each group has a term and an output associated with it in the PAL equations for the EC PAL 410. Thus, Group A is associated with term and output "A", Group B is associated with term and output "B", Group C is associated with term and output "C", and Group D is associated with term and output "D."

Eight Cylinder Mode

The operation of the present invention will now be described when operating in eight cylinder mode. With reference to the PAL equations for the EC PAL 410 for the preferred embodiment of the present invention in Appendix A, if the inputs IDLE, PWR_REQ, FT, HT, FXT_TP, LOW_TEMP satisfy the equation:

$$(LOW_TEMP+/IDLE)\cdot(IDLE+LOW_TEMP+/FXD_TP+FT+HT+PWR_REQ)=1 \quad (1)$$

then the terms and outputs "A", "B", "C", "D" are set to a logic '0'. Equation 1 defines the operating conditions which will cause the split engine controller 200 to operate the engine in a non-split engine mode, with all the engine cylinders activated. The full complement of engine cylinders may be activated either because the full power of the engine is required, such as when the throttle is positioned at full throttle or half-throttle, or because the engine is cold and needs to warm-up quickly. As will be described below, when all the outputs "A", "B", "C", "D" are set to a logic '0', all cylinders are operated. However, it will be apparent to one skilled in the art, that other equations, using different terms or sensor inputs, may be used in determining when to operate the engine in the eight cylinder mode.

Figure 7A:
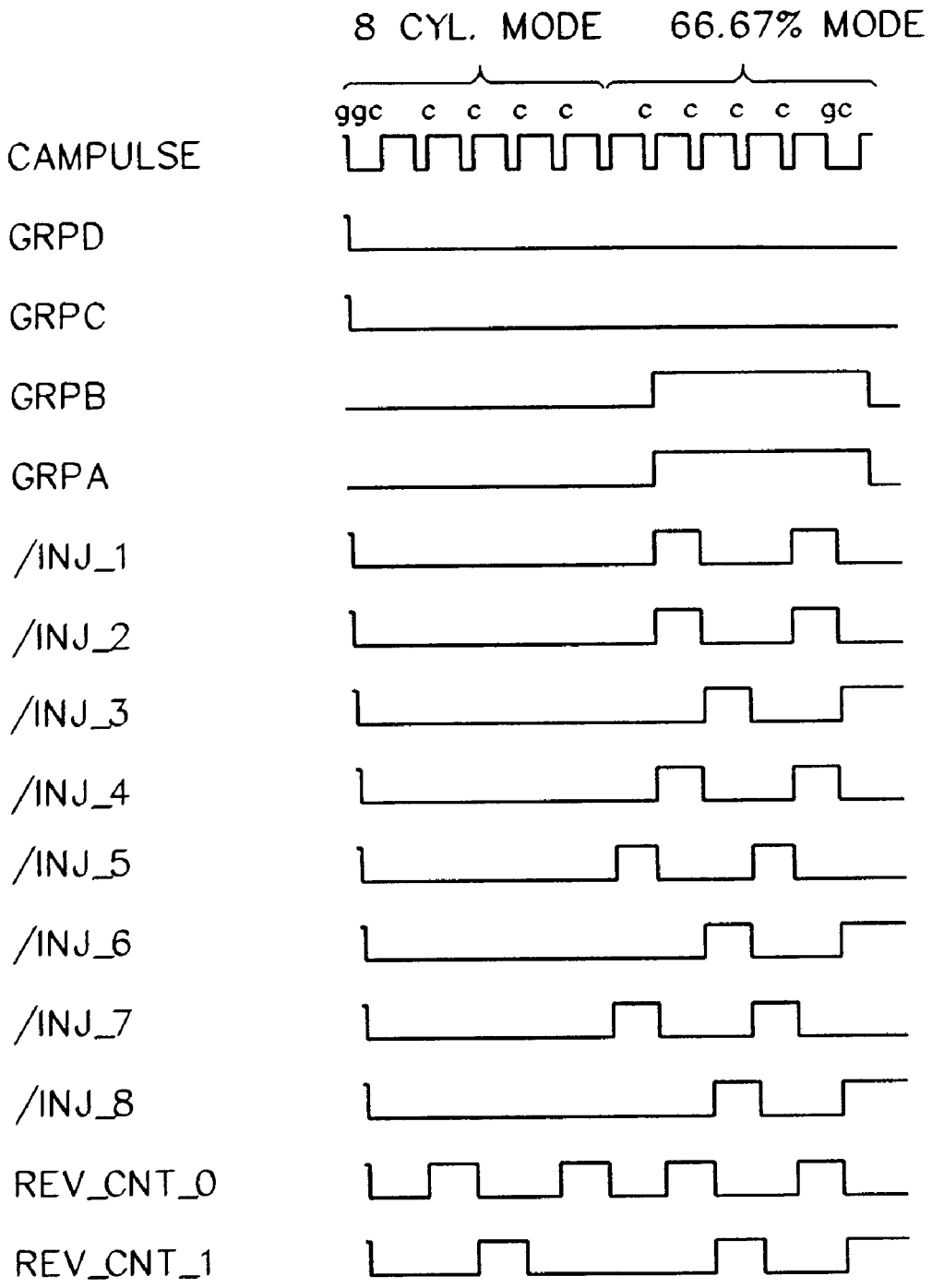
FIG. 7A is a timing diagram illustrating the eight cylinder and 66.67% operating modes of the preferred embodiment.

With reference to the PAL equations for the IC PAL 420 in Appendix B, and the timing diagram illustrated in FIG. 7A, if the outputs A, B, C, D of the EC PAL 410 are set to a logic '0', and therefore the inputs GRPA, GRPB, GRPC, GRPD of the IC PAL 420 are set to a logic '0', then the IC PAL 420 terms INJ_1, INJ_2, INJ_3, INJ_4, INJ_5, INJ_6, INJ_7, INJ_8 are set to a logic '1'. Each term INJ_1, INJ_2, INJ_3, INJ_4, INJ_5, INJ_6, INJ_7, INJ_8 is associated with a respective output /INJ_1, /INJ_2, /INJ_3, /INJ_4, /INJ_5, /INJ_6, /INJ_7, /INJ_8 having a logic state that is the complement of its associated term. Each output /INJ_1, /INJ_2, /INJ_3, /INJ_4, /INJ_5, /INJ_6, /INJ_7, /INJ_8 is connected to a respective one of the injector drivers 430. Each of the injector drivers 430 is in turn connected to one of the fuel injectors 140. When any term INJ_1, INJ_2, INJ_3, INJ_4, INJ_5, INJ_6, INJ_7, INJ_8 is set to a logic '1', and thus the respective output /INJ_1, /INJ_2, /INJ_3, /INJ_4, /INJ_5, /INJ_6, /INJ_7, /INJ_8 is set to a logic '0', the associated injector 140 are activated. Thus, as all the terms INJ_1, INJ_2, INJ_3, INJ_4, INJ_5, INJ_6, INJ_7, INJ_8 are set to a logic '1', all eight injectors are activated, placing the engine in eight cylinder, non-split engine, mode.

Four Cylinder 50% Power Mode

The operation of the present invention will now be described when operating in the four cylinder mode. When the engine is operating in the four cylinder mode (i.e. the output FOURCO of the EC PAL 410 is set active high), then for a given time period, which, in the preferred embodiment is the period of an engine cycle of two revolutions, only four of the eight injectors 140 are enabled. As defined by the equations for the EC PAL 410 in Appendix A, the output FOURCO is set to an active high, logic '1' when both the input LOW_TEMP is at a logic '0', indicating the engine is not cold, and the input IDLE is at a logic '1' indicating the engine is idling. Thus, the split engine controller 200 will place the engine in the four cylinder mode when the engine has warmed-up and the engine does not need the power or torque available when operating on all eight cylinders. With reference to the PAL equations for the EC PAL 410 in Appendix A, the PAL equations for the IC PAL 420 in Appendix B, and the waveforms in FIG. 7B, the EC PAL 410 and the IC PAL 420 operate as follows.

When one of the terms A, B, C, D and associated output is set to a logic '0', the injectors 140 associated with their respective term and output are enabled. Thus, as can be seen from the definition of the terms A, B, C, D, and from FIGS. 5 and 7, when the term FOURCO transitions from a low to an active high, as occurs when the split engine controller 200 transitions from an eight cylinder mode to a four cylinder mode, then the terms A, B, C, D are set to an active high '1'. The EC PAL 410 outputs A, B, C, D are connected respectively to inputs GRPA, GRPB, GRPC, GRPD of the IC PAL 420. As can be seen from the PAL equations in Appendix B for the IC PAL 420, the inputs GRPA, GRPB, GRPC, GRPD respectively have terms GRPA, GRPB, GRPC, GRPD associated with them. The IC PAL 420 is clocked by the processed cam pulses from the cam processing circuitry 390. One cam pulse is generated for every two engine revolutions. One engine cycle is equal to two engine revolutions. Thus, the cam pulses are used to synchronize the operation of the IC PAL 420, and the engine controller 200 as a whole, to the engine revolutions.

Referring to Appendix B, the term FOURCLYMODE is set high when either the terms A, C are both a '1' and when the terms B, D are both a '1'. Thus, when the term FOURCO is a '1', the term FOURCLYMODE is a '1'. The term FIRE_1764, as defined in Appendix B, is used to toggle between a first set of four cylinders and a second set of four cylinders every two engine revolutions. The term FIRE_1764 is a registered term, clocked by the cam pulse every two engine revolutions. Thus, when the term FOURCLYMODE is a '1' the term FIRE_1764 will change logic states every two engine revolutions. On a first engine cycle, if the term FIRE_1764 is at a logic '1' state, and the term FOURCLYMODE is likewise at a logic '1' state, then the terms INJ_1, INJ_4, INJ_6, INJ_7 are set high and the terms INJ_2, INJ_3, INJ_5, INJ_8 are set low. Thus, Group A and Group C injectors are activated. At the next cam pulse, the term FIRE_1764 transitions from a logic '1' to a logic '0'. When the term FIRE_1764 is at a logic '0' state, and the term FOURCLYMODE is at a logic '1' state, then the terms INJ_2, INJ_3, INJ_5, INJ_8 are set high and the terms INJ_1, INJ_4, INJ_6, INJ_7 are set low. Thus, when the engine controller 200 operates the engine is the four cylinder mode a different set of fuel injectors and related cylinder will be used every two engine revolutions. This ensures that the cylinders wear evenly in a balanced manner. However, it will be apparent to one skilled in the art, that other equations, using different terms or sensor inputs, may be used in determining when to operate the engine in the four cylinder mode. Furthermore, in other embodiments of the present invention, the four cylinder mode is not used at all.

In an alternate embodiment, the split engine controller, while in the four cylinder mode, will activate alternate sets of four cylinders every time the engine controller transitions from the eight cylinder mode to the four cylinder mode, rather than every two engine revolutions.

Figure 5:
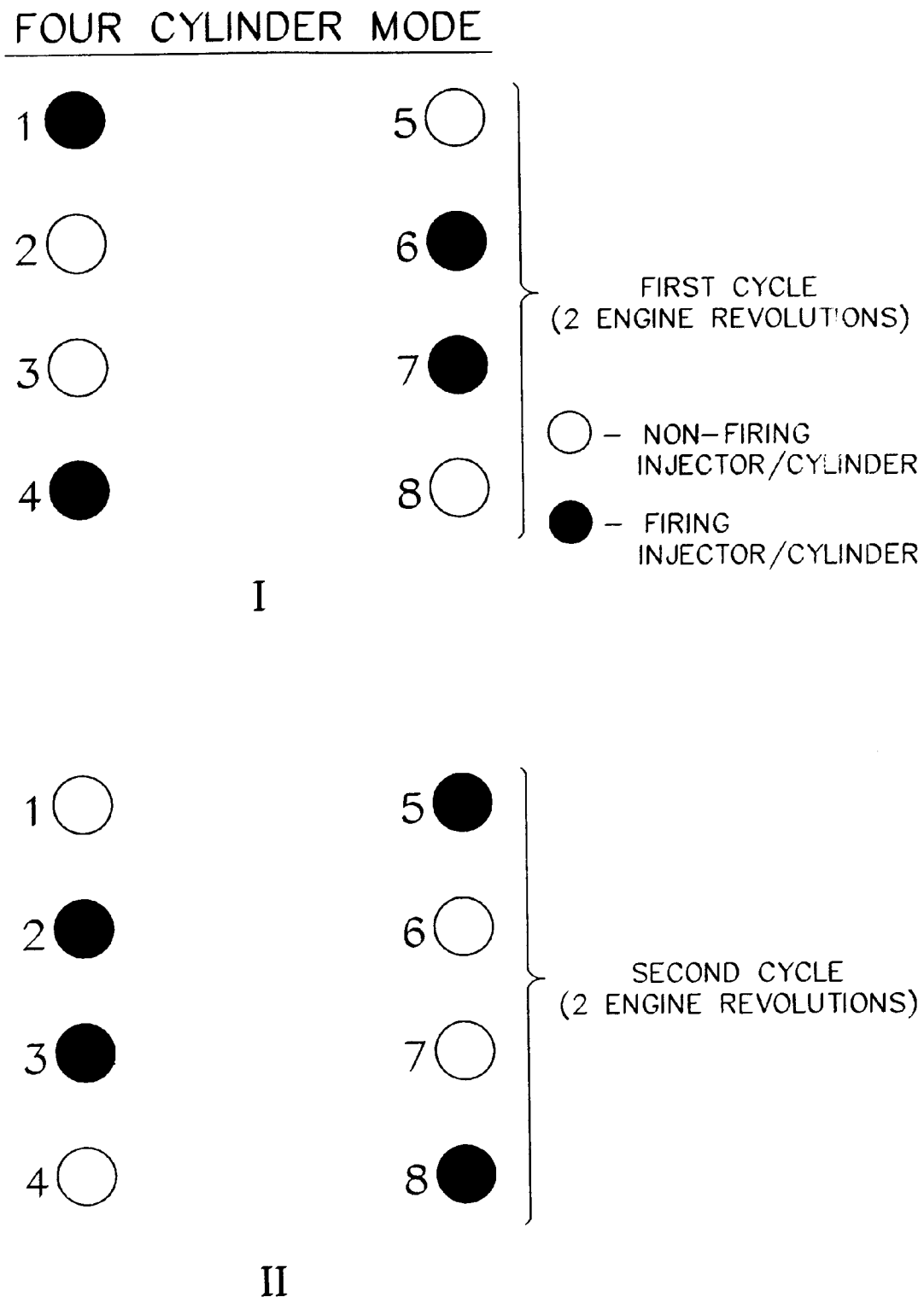
FIG. 5 illustrates the four cylinder operating mode of the preferred embodiment.

FIG. 5 illustrates the fuel injector activation of a typical V8 engine in the four cylinder mode, with only four injectors activated per engine cycle. The sequence of the injector 140 activation has been chosen for the following reason. The 4.6 liter V8 engine in the 1993 Ford Crown Victoria with the standard engine controller 100, operating in non-split engine mode, fires the injectors 140 in the following order: 1, 3, 7, 2, 6, 5, 4, 8. The aforementioned order causes the ignition of the cylinders to be evenly spaced in time, ensuring that operation of the cylinders is balanced. In a four cycle engine, such as that found in typical automobiles, it takes two revolutions of the engine to fire all the injectors. The four cylinder mode firing sequence, illustrated in FIG. 5, advantageously also causes the ignition of the cylinders to be evenly spaced in time, even though only four injectors are activated every engine cycle. The firing sequence when the term FIRE_1764='1' is 1, 7, 6, 4, and the firing sequence when the term FIRE_1764='0' is 3, 2, 5, 8. The firing sequence is the same as for the standard eight cylinder mode, except when the term FIRE_1764='1' one subset of four injectors is not activated while when the term FIRE_1764='0' the second subset of four injectors is not activated. The split engine controller 200 utilizes the cam pulses to synchronize the operation of the IC PAL 420, and hence the alternating activation of the first subset of injectors and the second subset of injectors, with the rotation of the engine. Thus, the firing pattern has been advantageously selected and synchronized to provide for an even, balanced engine operation.

Furthermore, the four non-firing cylinders act as air pumps as air is still admitted into the cylinders via valve openings and exhausted through the exhaust system. This substantially reduces pollutant concentrations in the exhaust gases. Furthermore, by alternately firing and then resting subsets of four cylinders, the cylinders remain cooler than if the same subset of four cylinders were firing at all times. Keeping the cylinders cooler further reduces exhaust pollutants, such as NOX, and causes the engine cylinders to wear evenly.

The generation of the IAC output for the engine idle air control will now be described. If the term FOURCO has been set active high, indicating four cylinder operation, by the EC PAL 410, and if the input PW is set active high, and the input FXD_TP is set active high, indicating that the throttle is in a fixed position, and if the input PWR_REQ is set low, indicating that no additional power is required, then the output IAC is set active high by the EC PAL 410 which activates the engine idle air control solenoid via the IAC driver 208. The input PW is approximately a 50% duty cycle clock signal. Thus, when the engine requires additional air at idle, such as when an air conditioner is turned on, the term IAC is activated with an approximately 50% duty cycle, causing the idle air control solenoid to open the air valve halfway.

75% Power Mode

Figure 9:
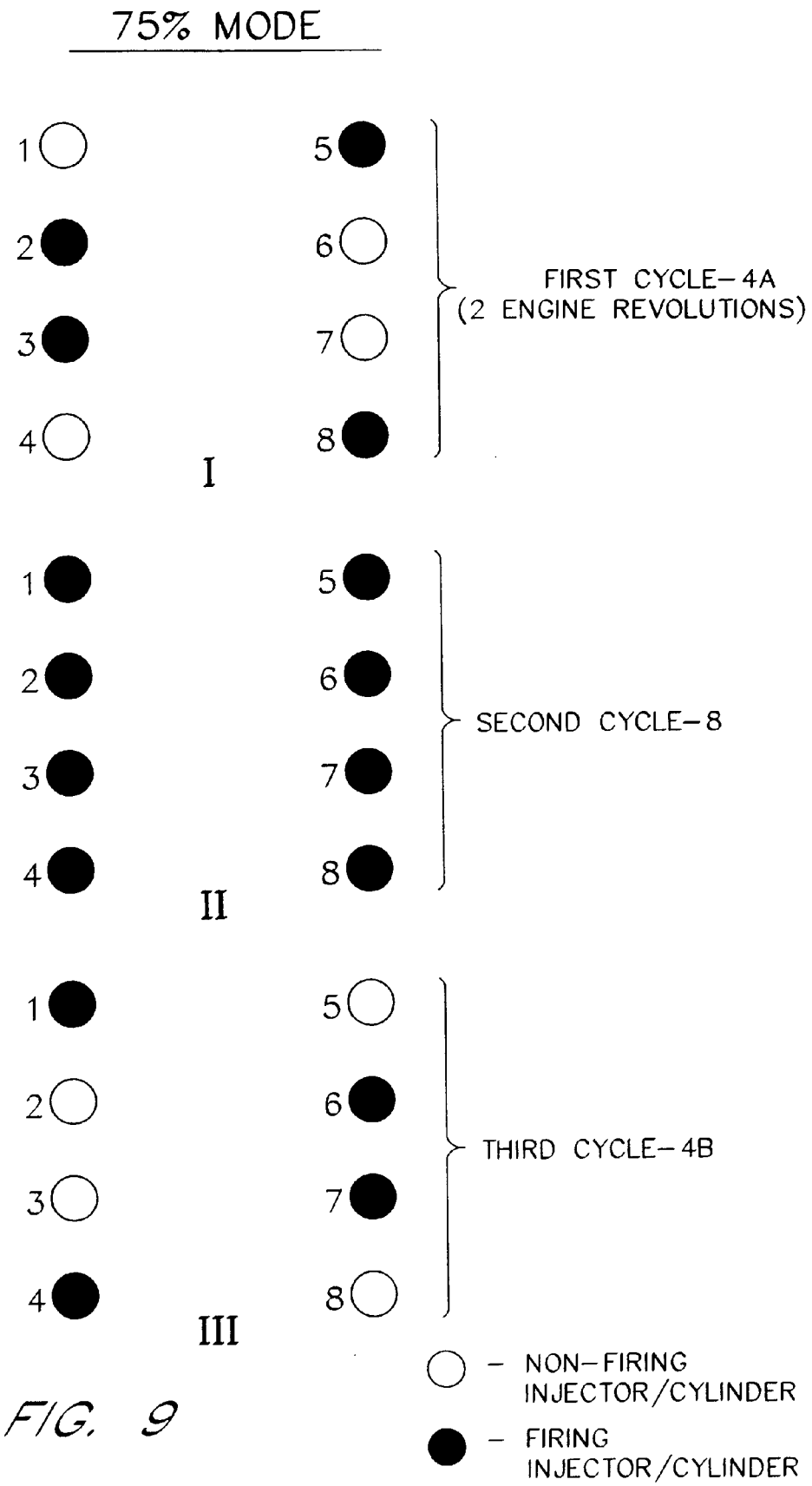
FIG. 9 illustrates the 75% operating mode of the preferred embodiment.

The operation of the present invention will now be described when operating in 75% power mode. When operating the engine at 75% of full power, the engine controller 200 alternately enables a first group of four cylinders, then all eight cylinders, and then a second group of four cylinders. Therefore, in the 75% mode, the controller 200 activates the cylinders in a 8-4A-8-4B pattern, as illustrated in FIG. 9. Thus, when a significant percentage of the total available engine power is required, the engine operates in the 75% power mode, while advantageously resting alternate halves of the cylinders one third of the time.

With reference to the PAL equations for the EC PAL 410 and the IC PAL 420 in Appendix A and Appendix B respectively, the preferred embodiment of the split engine controller 200 will place the engine in the 75% power mode when the following equation from Appendix B is satisfied:

$$(GRPA+GRPB+GRPC+GRPD)\cdot/(GRPA\cdot GRPC)\cdot/(GRPB\cdot GRPD)\cdot VGTR40 \quad (2)$$

For Equation 2 be satisfied, the following equation must be satisfied:

$$/IDLE\cdot FXT_TP\cdot/FT\cdot/HT\cdot/PWR_REQ\cdot/LOW_TEMP=1 \quad (3)$$

Thus, the engine controller 200 operates the engine in 75% power mode when the engine is not idling, and the throttle position is fixed at substantially steady-state, and the throttle position is neither at full throttle or half throttle, and no additional power is required, and the engine is not cold, and the vehicle is traveling at greater than 40 MPH. Equations 2 and 3 essentially defines the operation of an engine while cruising at a speed greater than 40MPH, and hence when a substantial portion, but not all, of the power offered by operating in eight cylinder mode is required. However, it will be apparent to one skilled in the art, that other equations, using different terms or sensor inputs, may be used in determining when to operate the engine in 75% mode. Furthermore, in other embodiments of the present invention the 75% mode is not used at all.

The terms FIRE_8 and FIRE_1764, as defined in Appendix B, are used by the engine controller in determining when to transition from operating the first group of four cylinders to operating all eight cylinders and then when to transition to operating the second group of four cylinders. The term FIRE_8 is a registered term, clocked by the cam pulse every two engine revolutions. Thus, when the term MODE_848 is a '1' the term FIRE_8 will change logic states every two engine revolutions. The term FIRE_1764 is likewise a registered term, clocked by the cam pulse every two engine revolutions. As defined by the equations in Appendix B, the terms FIRE_1764 and FIRE_8 act as a modula 4 counter, with the term FIRE_1764 as the most significant bit and the term Fire_8 as the least significant bit, as illustrated in Table 1, below.

Figure 7B:
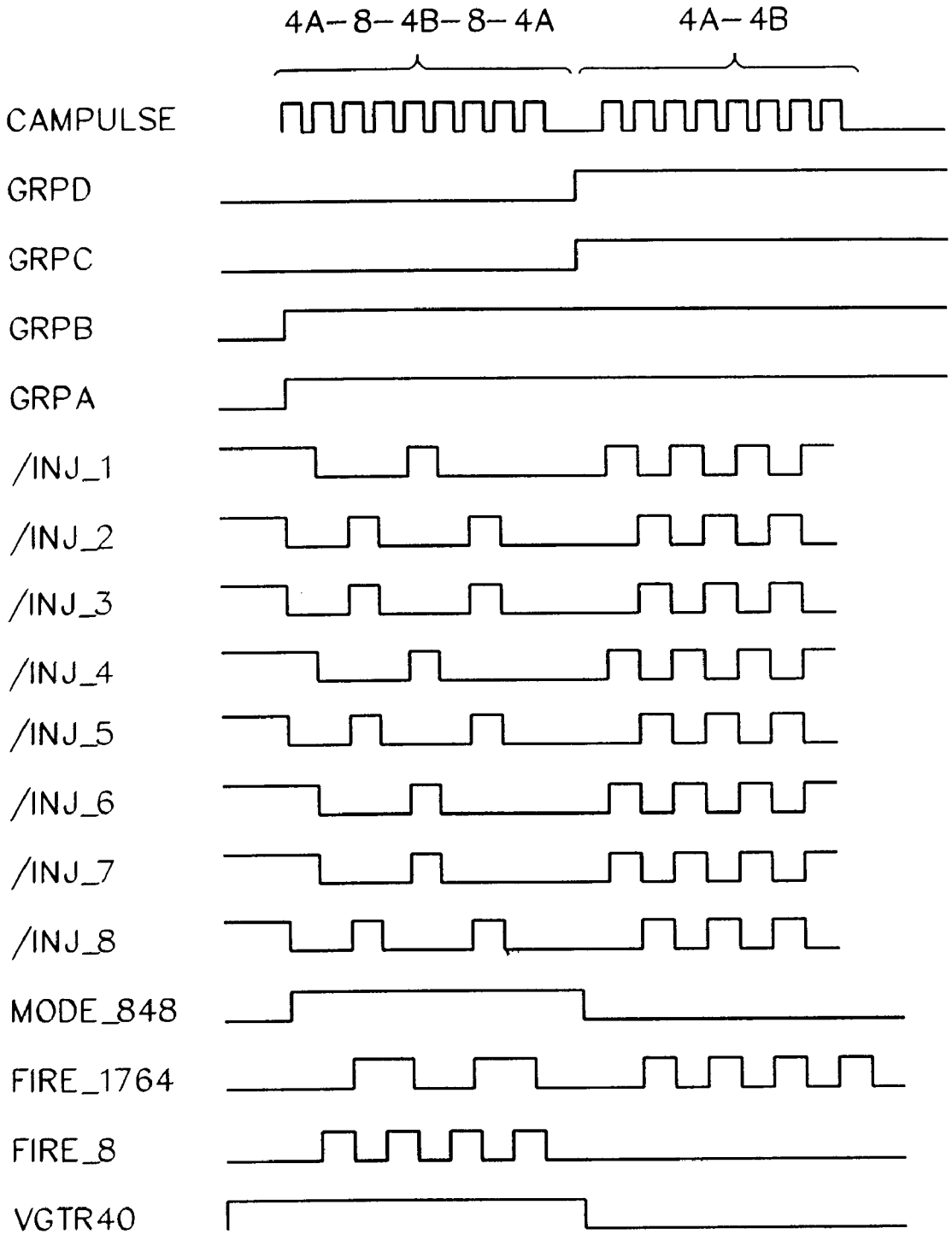
FIG. 7B is a timing diagram illustrating the 50% and 75% operating modes of the preferred embodiment.

In the 75% mode, an injector will be activated only when the term MODE_848 is set to a logic '1' and the appropriate count is reached by the modula 4 counter formed by the terms FIRE_1764, FIRE_8, as defined by the logic equations for the IC PAL 420 in Appendix B: Table 1 and FIG. 7B illustrate the counts and input conditions necessary to activate a respective injector.

TABLE 1

| MODE_848 | FIRE_1764 | FIRE_8 | ACTIVATED INJECTORS |
|---|---|---|---|
| 1 | 0 | 0 | 2, 3, 5, 8 |
| 1 | 0 | 1 | 1, 2, 3, 4, 5, 6, 7, 8 |
| 1 | 1 | 0 | 1, 4, 6, 7 |
| 1 | 1 | 1 | 1, 2, 3, 4, 5, 6, 7, 8 |

'1' = TRUE
'0' = FALSE
'X' = DON'T CARE

The technique used to implement the 75% mode offers numerous advantages over previous embodiments which typically operate by using only six of the eight cylinders. The 75% mode of the preferred embodiment offers a reduction in fuel consumption while still providing enough engine power to overcome wind resistance while cruising at speeds greater than 40 MPH. Additionally, all injectors and associated cylinders are rested in turn while operating in the 75% mode, ensuring even, reduced wear of the cylinders. Furthermore, when an injector is not activated, the cylinder operates as an air pump, further reducing engine emissions. Thus, the technique used by the preferred embodiment overcomes the limitations of traditional implimentations of the 75% mode, which constantly used the same set of six of the eight cylinders, resulting in the uneven wear of the cylinders and the unbalanced operation of the engine.

As previously noted, the 4.6 liter V8 engine in the 1993 Ford Crown Victoria with the standard engine controller 100, operating in non-split engine mode, fires the injectors 140 in the following order: 1, 3, 7, 2, 6, 5, 4, 8. The aforementioned order causes the ignition of the cylinders to be evenly spaced in time, ensuring that operation of the cylinders is balanced. The present invention likewise follows this sequence when operating in 75% power mode, except when only four injectors are activated, every other cylinder in the 1, 3, 7, 2, 6, 5, 4, 8 sequence is not fired, as illustrated below by Table 2. The split engine controller 200 utilizes the cam pulses to synchronize the operation of the IC PAL 420, and hence the activation of the injectors, with the rotation of the engine. Thus, the split engine controller 200 advantageously provides a method of activating and resting the injectors and associated cylinders, enabling a balanced, smooth, operation of the automobile engine.

TABLE 2

FIRING SEQUENCE OF INJECTORS/CYLINDERS FOR 75% MODE

| CYCLE 1 | | | | | | | | CYCLE 2 | | | | | | | | CYCLE 3 | | | | | | | |
|---|---|---|---|---|---|---|---|---|---|---|---|---|---|---|---|---|---|---|---|---|---|---|---|
| 1 | 3 | 7 | 2 | 6 | 5 | 4 | 8 | 1 | 3 | 7 | 2 | 6 | 5 | 4 | 8 | 1 | 3 | 7 | 2 | 6 | 5 | 4 | 8 |
| S | F | S | F | S | F | S | F | F | F | F | F | F | F | F | F | F | S | F | S | F | S | F | S |

"F" = FIRE
"S" = SKIP 66.67% Power Mode

The operation of the present invention will now be described when operating in 66.7% power mode. With reference to the PAL equations for the EC PAL 410 and the IC PAL 420 in Appendix A and Appendix B respectively, the split engine controller 200 will place the engine in 66.67% power mode when the following equation is satisfied:

$$/IDLE \cdot FXT_TP \cdot /FT \cdot /HT \cdot /PWR_REQ \cdot /LOW_TEMP \cdot /MODE_848=1 \quad (4)$$

Thus, the engine controller 200 operates the engine in 66.67% power mode when then engine is not idling, and the throttle position is fixed at substantially steady-state, and the throttle position is neither at full throttle or half throttle, and no additional power is required, and the engine is not cold, and the term MODE_848 is at a logic '0'. Equation 2 essentially defines the operation of an engine while cruising at speeds of 40 MPH or less, and hence when the power offered by operating in 100%, eight cylinder mode, or 75%, six cylinder mode, is not required. However, it will be apparent to one skilled in the art, that other equations, using different terms, may be used in determining when to operate the engine in the 66.67% power mode. Furthermore, in other embodiments of the present invention, the 66.67% power mode is not used at all.

Figure 6:
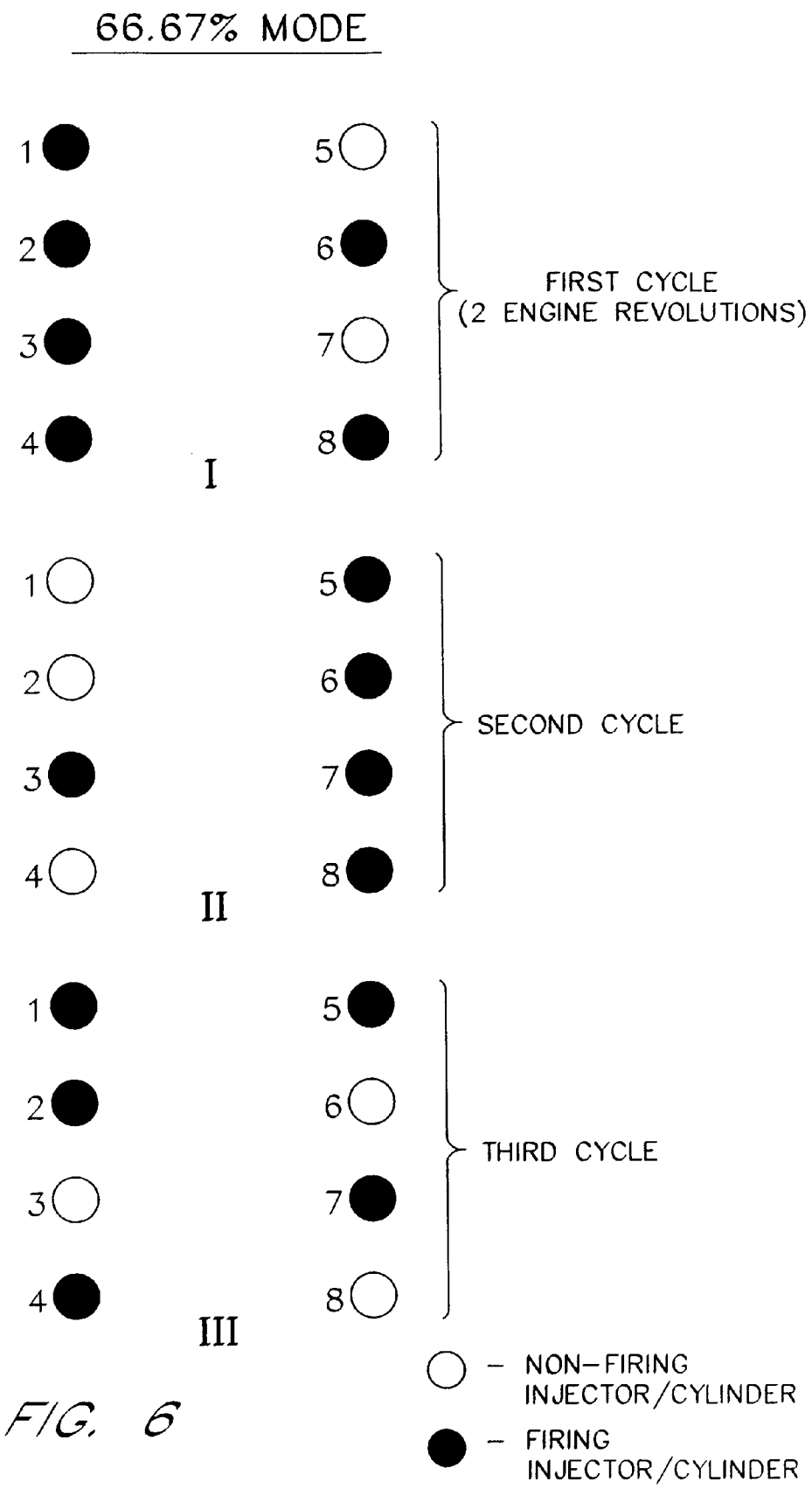
FIG. 6 illustrates the 66.67% operating mode of the preferred embodiment.

When Equation 4 is satisfied, then the equations which define the IC PAL 420 causes the injectors 140 to activate, as illustrated in FIG. 6, so that over three engine cycles the injectors are activated an average of 66.67% of the time compared to the number injector activations which occurs while the engine is being operated in normal eight cylinder mode. This is accomplished as follows. The terms REV_CNT_0, REV_CNT_1 serve to define a modula 2 counter, with the term REV_CNT_0 being the least significant bit (LSB) and with the term REV_CNT_1 being the most significant bit (MSB). The modula 2 counter is clocked by the signal on the input CLK-CAMPULSE. An injector will be activated when the appropriate count is reached by the modula 2 counter and the inputs GRPA, GRPC, GRPDC, GRPD are set at the appropriate states, as defined by the logic equations for the IC PAL 429 in Appendix B. Table 3 and FIG. 7A illustrate the counts and input conditions necessary to activate a respective injector.

TABLE 3

| GRPA | GRPB | GRPC | GRPD | REV CNT 1 | REV CNT 0 | ACTIVATED INJECTORS |
|---|---|---|---|---|---|---|
| 1 | X | 0 | X | 0 | 0 | 1,2,3,4,6,8 |
| X | 1 | X | 0 | 0 | 0 | 1,2,3,4,6,8 |
| 1 | X | 0 | X | 0 | 1 | 3,5,6,7,8 |
| X | 1 | X | 0 | 0 | 1 | 3,5,6,7,8 |

TABLE 3-continued

| GRPA | GRPB | GRPC | GRPD | REV CNT 1 | REV CNT 0 | ACTIVATED INJECTORS |
|---|---|---|---|---|---|---|
| 1 | X | 0 | X | 1 | 0 | 1,2,4,5,7 |
| X | 1 | X | 0 | 1 | 0 | 1,2,4,5,7 |

'1' = TRUE
'0' = FALSE
'X'= DON'T CARE

The technique used to implement the 66.67% mode offers several advantages over previous embodiments. The 66.67% offers a reduction in fuel consumption while still providing enough engine power while cruising. Additionally, all injectors and associated cylinders are rested in turn while operating in the 66.67% mode, ensuring even, reduced wear of the cylinders. Furthermore, when an injector is not activated, the cylinder operates as an air pump, further reducing engine emissions.

As previously noted, the 4.6 liter V8 engine in the 1993 Ford Crown Victoria with the standard engine controller 100, operating in non-split engine mode, fires the injectors 140 in the following order: 1, 3, 7, 2, 6, 5, 4, 8. The aforementioned order causes the ignition of the cylinders to be evenly spaced in time, ensuring that operation of the cylinders is balanced. The present invention likewise follows this sequence when operating in 66.67% power mode, except every third cylinder in the 1, 3, 7, 2, 6, 5, 4, 8 sequence is skipped, as illustrated below by Table 4 and by FIG. 7A. The split engine controller 200 utilizes the cam pulses to synchronize the operation of the IC PAL 420, and hence the activation of the injectors, with the rotation of the engine. Thus, the split engine controller 200 advantageously provides a method of activating and resting the injectors and associated cylinders, enabling a balanced, smooth, operation of the automobile engine.

TABLE 4

FIRING SEQUENCE OF INJECTORS/CYLINDERS FOR 66.67% MODE

| CYCLE 1 | | | | | | | | CYCLE 2 | | | | | | | | CYCLE 3 | | | | | | | |
|---|---|---|---|---|---|---|---|---|---|---|---|---|---|---|---|---|---|---|---|---|---|---|---|
| 1 | 3 | 7 | 2 | 6 | 5 | 4 | 8 | 1 | 3 | 7 | 2 | 6 | 5 | 4 | 8 | 1 | 3 | 7 | 2 | 6 | 5 | 4 | 8 |
| F | F | S | F | F | S | F | F | S | F | F | S | F | F | S | F | F | S | F | F | S | F | F | S |

"F" = FIRE
"S" = SKIP

Although this invention has been described in terms of a certain preferred embodiment, other embodiments apparent to those of ordinary skill in the art are also within the scope of this invention. Accordingly, the scope of the invention is intended to be defined only by the claims which follow.

APPENDIX A

PALASM DESIGN DESCRIPTION FOR THE ENGINE CONTROLLER PAL 410

```
Declaration Segment
TITLE: Engine Control Logic
;                                   PIN Declarations
FOURCO_CLK                          ;CLOCK
LOWTEMP        COMBINATORIAL        ; INPUT
FXD_TP         COMBINATORIAL        ; INPUT
FT             COMBINATORIAL        ; INPUT
HT             COMBINATORIAL        ; INPUT
PWR_REQ        COMBINATORIAL        ; INPUT
PW             COMBINATORIAL        ; INPUT
IDLE           COMBINATORIAL        ; INPUT
FOURCO         COMBINATORIAL        ; OUTPUT
A              COMBINATORIAL        ; OUTPUT
```

APPENDIX A-continued

PALASM DESIGN DESCRIPTION FOR THE ENGINE CONTROLLER PAL 410

```
    B                COMBINATORIAL    ; OUTPUT
    C                COMBINATORIAL    ; OUTPUT
    D                COMBINATORIAL    ; OUTPUT
    IAC              COMBINATORIAL    ; OUTPUT
;                                     Boolean Equation Segment
EQUATIONS
FOURCO = /LOWTEMP * IDLE;
IAC = PW * /LOWTEMP * FXD_TP * FOURCO * /PWR_REQ;
A = FOURCO
    + /IDLE * FXD_TP * /FT * /HT * /PWR_REQ * /LOWTEMP;
B = FOURCO
    + /IDLE * FXD_TP * /FT * /HT * /PWR_REQ * /LOWTEMP;
C = FOURCO;
D = FOURCO;
```

APPENDIX B

PALASM DESIGN DESCRIPTION FOR THE INJECTOR CONTROLLER PAL 420

```
    Declaration Segment
    TITLE Injector Controller
    ;                                 Declarations
    CLOCK            COMBINATORIAL    INPUT
    MODE_848         REGISTERED       OUTPUT
    FIRE_8           REGISTERED       OUTPUT
    FOURCLYMODE      REGISTERED       OUTPUT
    FIRE_1764        REGISTERED       OUTPUT
    GRPD             COMBINATORIAL    INPUT
    GRPC             COMBINATORIAL    INPUT
    GRPB             COMBINATORIAL    INPUT
    GRPA             COMBINATORIAL    ; INPUT
    /INJ_1           COMBINATORIAL    ; OUTPUT
    /INJ_2           COMBINATORIAL    ; OUTPUT
    /INJ_3           COMBINATORIAL    ; OUTPUT
    /INJ_4           COMBINATORIAL    ; OUTPUT
    /INJ_5           COMBINATORIAL    ; OUTPUT
    /INJ_6           COMBINATORIAL    ; OUTPUT
    /INJ_7           COMBINATORIAL    ; OUTPUT
    /INJ_8           COMBINATORIAL    ; OUTPUT
    REV_CNT_0        REGISTERED       ; OUTPUT
    REV_CNT_1        REGISTERED       ; OUTPUT
```

```
;                                     Boolean Equation Segment
EQUATIONS
;8-4A-8-4B-8 MODE
MODE_848 = GRPA * /(GRPA*GRPC) * /(GRPB*GRPD) * VGTR40
    + GRPB * /(GRPA*GRPC) * /(GRPB*GRPD) * VGTR40
    + GRPC * /(GRPA*GRPC) * /(GRPB*GRPD) * VGTR40
    + GRPD * /(GRPA*GRPC) * /(GRPB*GRPD) * VGTR40
;
;FIRE 8 TOGGLE
FIRE 8 = /FIRE 8 * MODE_848
;
;FOUR CYLINDER MODE
FOURCLYMODE = GRPA * GRPC
    + GRPB * GRPD
;
;FOUR CYLINDER TOGGLE (4A–4b)
FIRE_1764 = FIRE_8 * /FIRE_1764 * MODE_848
    + FOURCLYMODE * /FIRE_1764
;
;Counter Set UP
REV_CNT_0 = /REV_CNT_0 * /REV_CNT_1
REV_CNT_1 = REV_CNT_0 * /REV_CNT_1
;
;INJECTOR SELECTION EQUATIONS
INJ_1 = GRPA * GRPC * FOURCLYMODE * FIRE_1764
  + GRPA * /GRPC * /REV_CNT_0 * /REV_CNT_1 * /MODE_848
  + GRPB * /GRPD * /REV_CNT_0 * /REV_CNT_1 * /MODE_848
  + GRPA * /GRPC * /REV_CNT_0 * REV_CNT_1 * /MODE_848
  + GRPB * /GRPD * /REV_CNT_0 * REV_CNT_1 * /MODE_848
  + /GRPA * /GRPB * /GRPC * /GRPD
```

APPENDIX B-continued

PALASM DESIGN DESCRIPTION FOR THE INJECTOR CONTROLLER PAL 420

```
  + MODE_848 * FIRE_8
  + MODE_848 * /FIRE_8 * FIRE_1764
;
INJ_2 = GRPB * GRPD * FOURCLYMODE * /FIRE_1764
  + GRPA * /GRPC * /REV_CNT_0 * /REV_CNT_1 * /MODE_848
  + GRPB * /GRPD * /REV_CNT_0 * /REV_CNT_1 * /MODE_848
  + GRPA * /GRPC * /REV_CNT_0 * REV_CNT_1 * /MODE_848
  + GRPB * /GRPD * /REV_CNT-0 * REV_CNT_1 * /MODE_848
  + /GRPA * /GRPB * /GRPC * /GRPD
  + MODE_848 * FIRE_8
  + MODE_848 * /FIRE_8 * /FIRE_1764
;
INJ_3 = GRPB * GRPD * FOURCLYMODE * /FIRE_1764
  + GRPA * /GRPC * /REV_CNT_0 * /REV_CNT_1 * /MODE_848
  + GRPB * /GRPD * /REV_CNT_0 * /REV_CNT_1 * /MODE_848
  + GRPA * /GRPC * /REV_CNT_0 * /REV_CNT_1 * /MODE_848
  + GRPB * /GRPD * /REV_CNT_0 * /REV_CNT_1 * /MODE_848
  + /GRPA * /GRPB * /GRPC * /GRPD
  + MODE_848 * FIRE_8
  + MODE_848 * /FIRE_8 * /FIRE_1764
INJ_4 = GRPA * GRPC * FOURCLYMODE * FIRE_1764
  + GRPA * /GRPC * /REV_CNT_0 * /REV_CNT_1 * /MODE_848
  + GRPB * /GRPD * /REV_CNT_0 * /REV_CNT_1 * /MODE_848
  + GRPA * /GRPC * /REV_CNT_0 * /REV_CNT_1 * /MODE_848
  + GRPB * /GRPD * /REV_CNT_0 * /REV_CNT_1 * /MODE_848
  + /GRPA * /GRPB * /GRPC * /GRPD
  + MODE_848 * FIRE_8
  + MODE_848 * /FIRE_8 * /FIRE_1764
INJ_5 = GRPB * GRPD * FOURCLYMODE * FIRE_1764
  + GRPA * /GRPC * /REV_CNT_0 * /REV_CNT_1 * /MODE_848
  + GRPB * /GRPD * /REV_CNT_0 * /REV_CNT_1 * /MODE_848
  + GRPA * /GRPC * /REV_CNT_0 * /REV_CNT_1 * /MODE_848
  + GRPB * /GRPD * /REV_CNT_0 * /REV_CNT_1 * /MODE_848
  + /GRPA * /GRPB * /GRPC * /GRPD
  + MODE_848 * FIRE_8
  + MODE_848 * /FIRE_8 * FIRE_1764
INJ_6 = GRPB * GRPD * FOURCLYMODE * FIRE_1764
  + GRPA * /GRPC * /REV_CNT_0 * /REV_CNT_1 * /MODE_848
  + GRPB * /GRPD * /REV_CNT_0 * /REV_CNT_1 * /MODE_848
  + GRPA * /GRPC * /REV_CNT_0 * /REV_CNT_1 * /MODE_848
  + GRPB * /GRPD * /REV_CNT_0 * /REV_CNT_1 * /MODE_848
  + /GRPA * /GRPB * /GRPC * /GRPD
  + MODE_848 * FIRE_8
  + MODE_848 * /FIRE_8 * FIRE_1764
INJ_7 = GRPB * GRPD * FOURCLYMODE * FIRE_1764
  + GRPA * /GRPC * /REV_CNT_0 * /REV_CNT_1 * /MODE_848
  + GRPB * /GRPD * /REV_CNT_0 * /REV_CNT_1 * /MODE_848
  + GRPA * /GRPC * /REV_CNT_0 * /REV_CNT_1 * /MODE_848
  + GRPB * /GRPD * /REV_CNT_0 * /REV_CNT_1 * /MODE_848
  + /GRPA * /GRPB * /GRPC * /GRPD
  + MODE_848 * FIRE_8
  + MODE_848 * /FIRE_8 * FIRE_1764
INJ_8 = GRPB * GRPD * FOURCLYMODE * FIRE_1764
  + GRPA * /GRPC * /REV_CNT_0 * /REV_CNT_1 * /MODE_848
  + GRPB * /GRPD * /REV_CNT_0 * /REV_CNT_1 * /MODE_848
  + GRPA * /GRPC * /REV_CNT_0 * /REV_CNT_1 * /MODE_848
  + GRPB * /GRPD * /REV_CNT_0 * /REV_CNT_1 * /MODE_848
  + /GRPA * /GRPB * /GRPC * /GRPD
  + MODE_848 * FIRE_8
  + MODE_848 * /FIRE_8 * FIRE_1764
```

What is claimed is:

1. A method of upgrading an automobile from non-split engine operation to split engine operation, said method essentially comprising the steps of:

(a) coupling a first engine connector intended for non-split engine use to a split engine controller; and (b) coupling a second connector intended for non-split engine use to said split engine controller.

2. The method as defined in claim 1 wherein said first connector is connected to a non-split engine controller and said second connector is connected to fuel injectors.

* * * * *